US005806607A

United States Patent [19]

Sanders

[11] Patent Number: 5,806,607

[45] Date of Patent: Sep. 15, 1998

[54] DEVICE FOR SKIMMING

[75] Inventor: Trevor G. Sanders, Berkshire, England

[73] Assignee: Thames Water Utilities Limited, Reading, England

[21] Appl. No.: 571,822

[22] PCT Filed: Jun. 20, 1994

[86] PCT No.: PCT/GB94/01324

§ 371 Date: Aug. 26, 1996

§ 102(e) Date: Aug. 26, 1996

[87] PCT Pub. No.: WO95/00713

PCT Pub. Date: Jan. 5, 1995

[30] Foreign Application Priority Data

Jun. 25, 1993 [GB] United Kingdom ..... 9313033

[51] Int. Cl.[6] ..... A01B 63/00

[52] U.S. Cl. ..... 172/253; 172/817; 37/407; 414/912

[58] Field of Search ..... 37/403–410, 468; 172/445.1, 245, 250–254, 810, 811, 817; 414/722, 912

[56] References Cited

U.S. PATENT DOCUMENTS

| | | | |
|---|---|---|---|
| 2,309,223 | 1/1943 | Staring | 37/403 X |
| 2,428,857 | 10/1947 | Smith | 172/445.1 |
| 2,613,912 | 10/1952 | Jordan | 37/403 X |
| 2,824,391 | 2/1958 | Roemer | 37/409 |
| 2,896,343 | 7/1959 | Raby | 37/407 |
| 3,034,238 | 5/1962 | McGee | 37/404 X |
| 3,163,945 | 1/1965 | Dooley | 37/405 |
| 3,209,475 | 10/1965 | Salna | 37/117.5 |
| 3,258,864 | 7/1966 | Beyers | 37/407 X |
| 4,179,227 | 12/1979 | Child, Jr. et al. | 405/182 |
| 4,201,000 | 5/1980 | Stanford | 37/117.5 |
| 4,241,525 | 12/1980 | Mann | 37/405 X |
| 4,372,063 | 2/1983 | Work | 37/409 X |
| 4,597,205 | 7/1986 | Guest | 37/403 X |
| 4,655,297 | 4/1987 | Bourgeois, Jr. | 172/445.1 |
| 5,191,943 | 3/1993 | Minor et al. | 172/445.1 X |
| 5,273,375 | 12/1993 | Plourde | 37/403 X |
| 5,367,796 | 11/1994 | Bowers et al. | 37/410 |
| 5,397,200 | 3/1995 | Seal | 172/445.1 X |
| 5,416,990 | 5/1995 | Otwell | 37/444 X |
| 5,526,591 | 6/1996 | Otwell | 37/444 |

*Primary Examiner*—Terry Lee Melius
*Assistant Examiner*—Victor Batson
*Attorney, Agent, or Firm*—Alix, Yale & Ristas, LLP

[57] ABSTRACT

The invention relates to a device mountable on a dozer blade for skimming a substance to a required depth, comprising an open box or collector for skimmed material, and a cutting edge of a rear wall which is used to effect skimming. The depth of skim is adjustable by height adjusting means which are described in the specification. A slow sand filter may be cleaned using a device according to the invention.

19 Claims, 7 Drawing Sheets

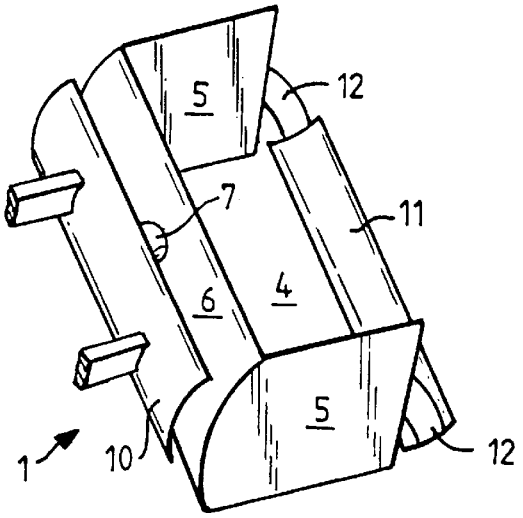
FIG. 1
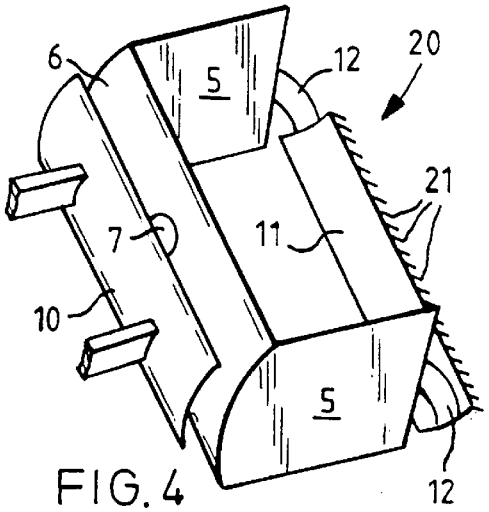
FIG. 4
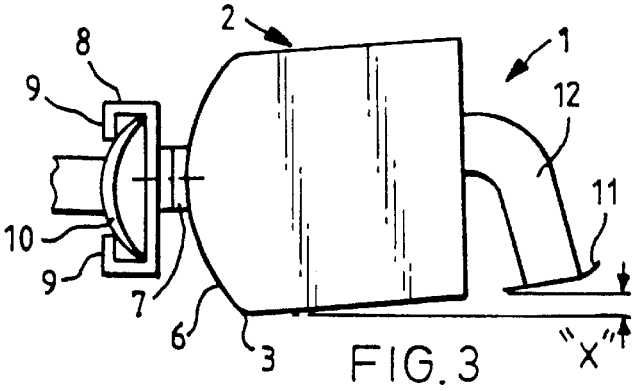
FIG. 3
FIG. 2
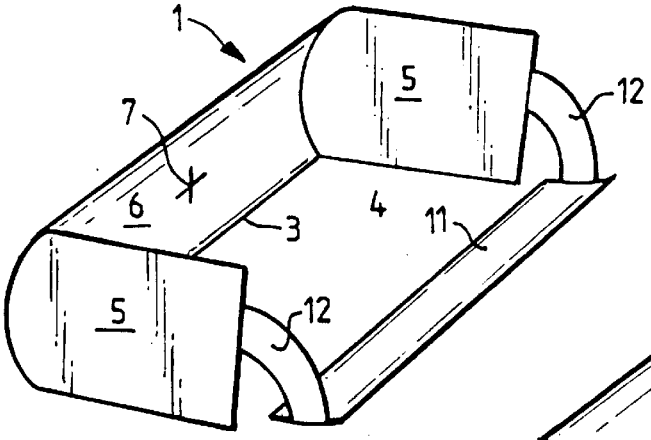
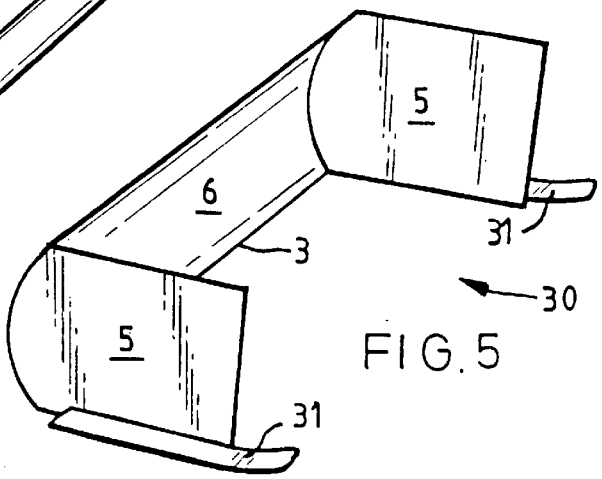
FIG. 5

DEVICE FOR SKIMMING

The invention relates to a device for skimming, particularly of a layer of skimmable material from a substrate such as a slow sand filter over which the device is in use traversed.

Slow sand filters are a well-established means of removing impurities from raw feed water, both "clean" and "dirty". They have however a high capital cost and require extensive land. Moreover, sand filters often become "clogged" with algae, debris and the like, and it is accordingly necessary to be able to clean the filter with as little disruption as possible. It is also necessary to be able to remove surplus sand from a filter, and granulated activated carbon where the filter comprises a "sandwich" of that material and sand.

According to a first aspect of the invention there is provided a device for skimming a layer from a substrate over which the device is in use traversed, characterised by a body defining an edge for skimming the substrate, a collector for material skimmed, and means for controlling the thickness of skim.

There may be a blade of the body defining the edge for skimming and the means for controlling the thickness of skim may comprise adjustable means for adjusting the position of the blade in relation to a fixed part of the device. This provides a relatively simple yet effective construction.

The fixed part of the device may comprise a rear wall of the device and the rear wall may be separated from a floor of the device by a gap through which skimmed material can pass. This provides a compact construction which is efficient for collectively skimmed material.

The blade may be mounted on a forward surface of the rear wall, or, alternatively the blade may be mounted on a rear surface of the rear wall of the device. Either construction is effective in skimming and adjusting the depth of skim.

The adjustable means may comprise an arrangement of a series of holes and a bolt means for passing through aligned holes. This is a simple yet effective mounting means.

The adjusting means may alternatively comprise a lifting arrangement for moving the blade bodily upwardly or downwardly, particularly a manually operable rotatable shaft and gear box arrangement.

The device may comprise an undersurface with a high slip surface, particularly a surface of a stainless steel skid part of the body of the device. This provides for ease of traverse over a substrate and tends to obviate any ploughing tendency.

The body may have pivot means for pivotal movement of the device in relation to a dozer blade.

There may be releasable clamping means whereby the device is releasably mountable on apparatus for moving the device. This provides for the device being an independent unit.

The apparatus may comprise a dozer having a dozer blade, and the clamping means may comprise toggle means for clamping to the blade.

There may be inter-slidable blocks for effecting clamping at at least one edge.

One block may be mountable in a hole in the dozer blade.

There may be a clamp plate adapted to clamp a part of the dozer blade opposite the clamp blocks.

The body may comprise a substantially U-shaped member the limbs and web of which comprise the collector and a lower (in use) edge of the web comprising the skimming edge.

There may be a skid or a plurality of skids mounted on a leading edge of the device.

There may be a plurality of forwardly projecting tines for collecting weed. This provides a particularly efficient construction.

According to a further aspect, the invention provides in combination, a dozer blade and a device as hereinbefore defined.

According to a further aspect, the invention provides a dozer, including a combination as hereinbefore defined.

Devices embodying the invention are hereinafter described, by way of example, with reference to the accompanying drawings.

FIG. 1 is a schematic perspective view from the rear of a device according to the invention mounted on a dozer blade;

FIG. 2 is, to an enlarged scale, a perspective view of in front of the device shown in FIG. 1;

FIG. 3 is a side elevational view of the device of FIGS. 1 and 2, and to a different scale from those FIGS.;

FIG. 4 is a perspective view of a second embodiment of the device according to the invention, being a modification of the device of FIGS. 1 to 3;

FIG. 5 is a perspective view from in front of a third embodiment of device according to the invention;

Figure 6:
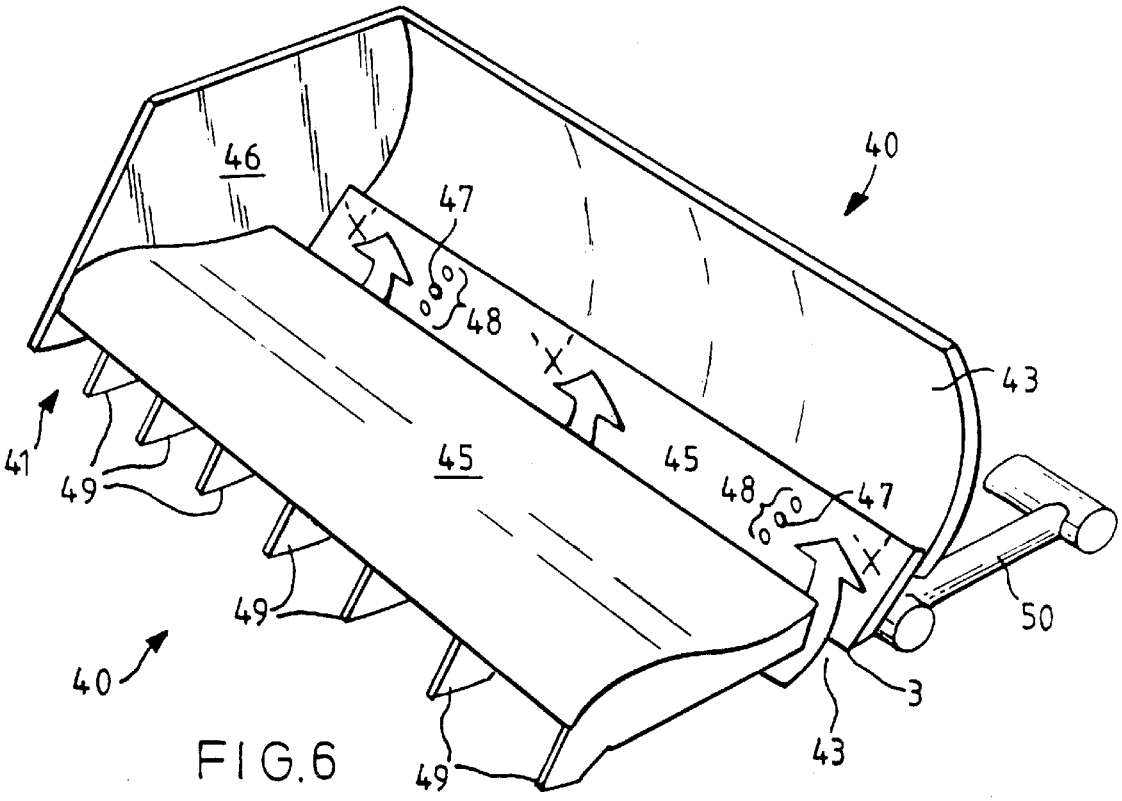
FIG. 6 is a perspective view of to an enlarged scale of a further embodiment of device according to the invention.

Referring to the drawings, in which like parts are indicated by like reference numerals, there is shown a device 1 (FIGS. 1 to 3) for skimming a layer of skimmable material from a substrate over which the device 1 is in use traversed, comprising a body 2 defining an edge 3 for skimming the substrate and a collector 4 for material skimmed, and means for controlling the thickness of skim.

The body 2 of generally U-shape in plan, being made of a suitable material such as metal, for example steel, comprising two spaced limbs or wings 5 connected by a web 6. The open space between the limbs 5 is in use, the forward end of the device 1 and the lower (as viewed and as considered in use) edge of the web is the skimming or cutting edge 3.

The web 6 also has a pivot means or connection 7 which connects the device with a clamping device 8 such as jaws 9 which can be offered up to and slid over a dozer blade 10 so that free, facing edges of the jaws 9 clamp on the convex (to the left as viewed) surface of the dozer blade 10 whereby to provide a rapidly releasable clamping connection, so that the device 1 is rapidly mountable on and detachable from the dozer blade 10.

In order to control the thickness of a particular "skim", there is mounted transversely of the device 1 at the upstream end, a skid 11 which is mounted on lateral support arms 12 so that its base is at a preset height above the cutting edge 3. This arrangement provides for control of the thickness of skim "X" (FIG. 3). The support arms 12 are, in a preferred embodiment, though not necessarily so, adjustable whereby to provide for height adjustment of the skid 11 so that various preset values of the distance "X" are provided.

In operation, the device 1 is mounted on the dozer blade 10 of an excavator (not shown). The device 1 provides for a transverse control of the depth of skim that is generally in the plane of the surface of for example a slow sand filter being skimmed, in addition to the "vertical" control provided by the usual "up and down" movement of the dozer blade per se. Thus a greater accuracy of skimming is provided for, and the device 1 is also effective to remove granular activated carbon (GAC) and sand where the slow sand filter is in effect a sandwich of GAC and sand.

The device 1 can thus be used for skimming off (and collecting) relatively thin layers of "spoil", prior to the spoil being off-loaded from between the limbs 5 by means of a bucket mounted on a dipper arm of the excavator.

In a modification (not shown) the skid 11 may be replaced by a plurality of skids, or by roller means such as a transverse roller or rollers (also not shown).

In a yet further embodiment, the device may also be applicable for collecting weed or like debris from the slow sand filter. In this embodiment the device 20 (FIG. 4) has a forwardly projecting plurality of spaced apart tines 21, the level of the tips of the tines 21 being adjustable in height and providing for the weed to be pushed ahead of the skid 11 so that its skimming operation is not hindered. The adjustability of the tines is such that different depths of weed, which might be lying on the filter bed, can be pushed forward as desired. In a further modification (not shown) the tines 21 or prongs may be mounted independently of and ahead (upstream) of the skid 11, on their own support arms.

In FIG. 5 there is shown a further embodiment of device 30 in which the skid is replaced by a ski 31 on, and outboard of, each limb 5. The thickness of the skim is adjustable by altering the set position of each ski 31 above the cutting edge 3. The ski or skid could also be replaced by wheels, where the substrate is relatively firm.

Referring now to FIGS. 6 to 15, there are shown further embodiments of device embodying the invention.

With primary reference to FIG. 6, the device 40 is essentially an open box having an open front 41, a floor or skid 42 (see FIG. 8) and a rear, concave wall 43 separated from the rear edge of the skid 42 (see FIG. 8) by a gap 44 traversing the width of the device 40. The wall 43 mounts a blade 45 the lower edge 3 of which as viewed is an edge for skimming the substrate. There are side wails or cheeks 46 (the right hand one of which is omitted for clarity). The box 40 thus defines a collector for skimmed material. The thickness of skim is controlled by setting the edge 3 of the blade 45 at a desired height by means of setting bolts 47 in a respective one of a series 48 of holes which pass through the blade and rear wall 43. When a hole in the blade is aligned with a desired hole in the rear wall, the bolts are inserted and locked up. Two series 48 of holes are shown in FIG. 6, there could be more, for improved stabilization of the blade.

There are on the underside of the skid, depending front tines or teeth 49, forming a comb which, as the device 40 is pushed over the substrate, push forward weed, algae and the like for subsequent removal. The tines 49 can also break up a perma-frost or frozen surface, in frosty weather to allow subsequent skimming by the edge 3. (This applies to all embodiments). The underside of the skid 42 (FIG. 8) also has a low coefficient of friction or high slip surface so that as it bears on the surface, sand, in a filter bed for example, does not adhere to the device and this does not provide "locking up" of sand on sand (particles on the skid "locking" with particles in the substrate), which would otherwise create a great resistance to forward travel of the device 40 during skimming. The means for providing this non-slip surface can be any suitable material, suitably a layer or coating of martinitic stainless steel, which is also resistant to abrading by sand or other material. The skid 42 (FIG. 8) could be formed wholly of martinitic stainless steel too. In use, the device 40 is attached as described with respect to the earlier embodiments, to a dozer blade by suitable clamping means and linkage. The height of the cutting edge 3 of the blade is then adjusted and set as required via the holes 48 and bolts 47, and the device 40 is set down by the linkage, the skid 42 (FIG. 8) resting directly on the sand, if for example it is sand of a slow sand filter in a water treatment works which is being skimmed. The dozer then pushes the device 40 forward. The teeth 49 clear the path of weed, which piles up in front for removal subsequently by a suitable tool. The blade 45 skims the sand substrate surface to a desired depth, while the base or underside of the skid 40 rides on the surface providing a firm support for the device and following the contour of the surface being skimmed, so that the blade skims accurately. The sand layer skimmed off passes through the gap 44 in the direction of the arrows 'X' and then, because of the curvature of the rear wall 43, is directed into the body of the device to be collected on the upper surface of the skid 42 (FIG. 8) between the side walls 46. When the device 40 is full of skimmed sand, or after a skimming pass, the sand is removed by a suitable tool such as a bucket scoop. In this connection, it will be understood that the device and dozer provide a composite unit, the dozer having an arm actionable by the driver and which carries a suitable grab or bucket for removing both accumulated weed, and skimmed sand.

Figure 7:
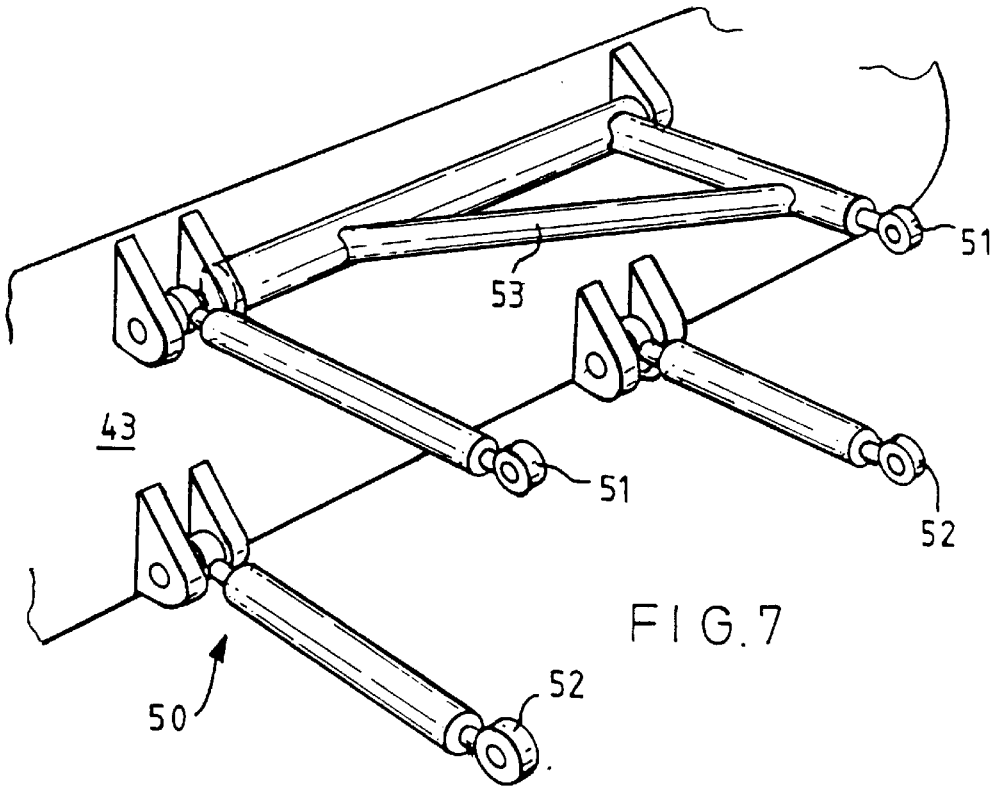
FIG. 7 is a perspective view of the part of the rear of the device of FIG. 6. from the rear.

Referring now to FIG. 7, there is shown schematically a view of the device from the rear, the rear of the rear wall having a four-link suspension 50 for connecting the device 40 with the dozer blade, there being two upper (as viewed) suspension points 51 and two lower suspension points 52, that is they respectively connect with the upper and lower edges of the dozer blade via suitable clamps, not shown in FIG. 7.

A diagonal strut 53 provides for lateral rigidity. These linkages via their linkage pins provide automatic control for terrain during skimming, so helping to maintain the depth of the skim.

Figure 8:
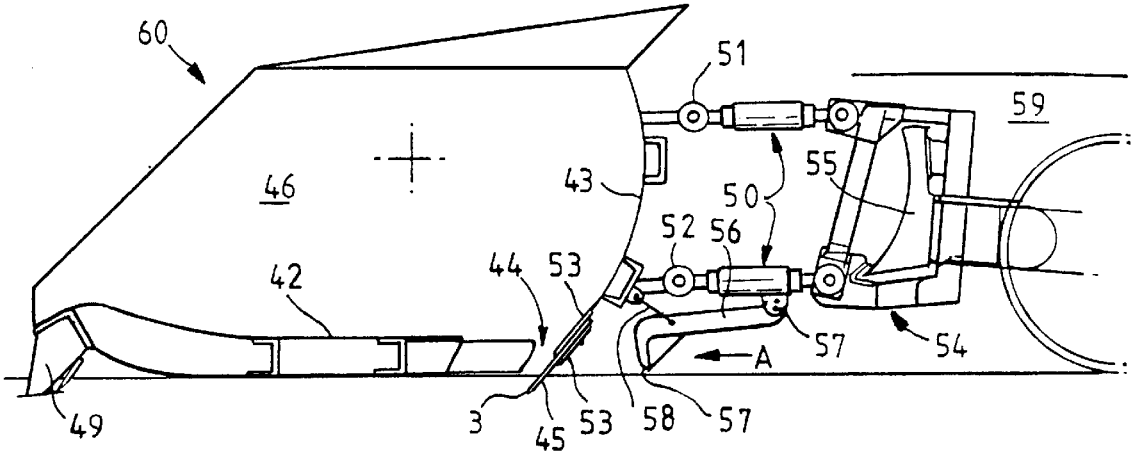
FIGS. 8 to 8B show respectively a side elevation, a detail of 'A' FIG. 8, and a part rear perspective view of a modified device according to the invention.
Figure 8A:
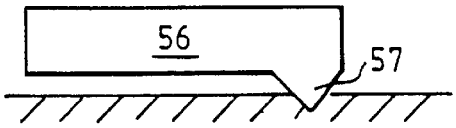
Figure 8B:
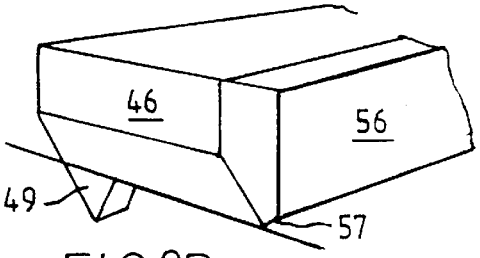

FIGS. 8 to 8*b* show a development (and FIG. 8 also shows feet or supports for the underside of the skid). In FIG. 8 the blade 43 is shown secured to the rear (as viewed) surface of rear wall 43, being adjustable in position between guide plates 53, and secured at a desired height by a bolt arrangement as before. The linkage 50 of FIG. 7 is shown connected to a frame 54, clamped to a dozer blade 55. The lower linkage 52 includes means in the form of a setting up aid which is a metal plate 56 with a downwardly directed tooth 57 at one end. The blade 56 is pivoted to the linkage 52 at 57 and spring mounted to the device at 58. The plate extends substantially parallel to the width of the device 60. When the dozer blade 55 is set down, the tooth 57 digs into the sand. As the dozer 59 moves forward, pushing the device 60 and thereby performing a skimming operation, the tooth 57 leaves a faint groove in the sand skimmed surface which can be observed by the driver, the plate 56 being between the lateral extent of the wheel of the dozer 59. The driver then has a rough guide to the depth of the dozer blade 45, and if the groove becomes a furrow or is clearly too deep, the dozer driver can then temporarily cease skimming, and adjust the depth by adjusting his linkages 56, and/or the blade 53 height.

Figure 9:
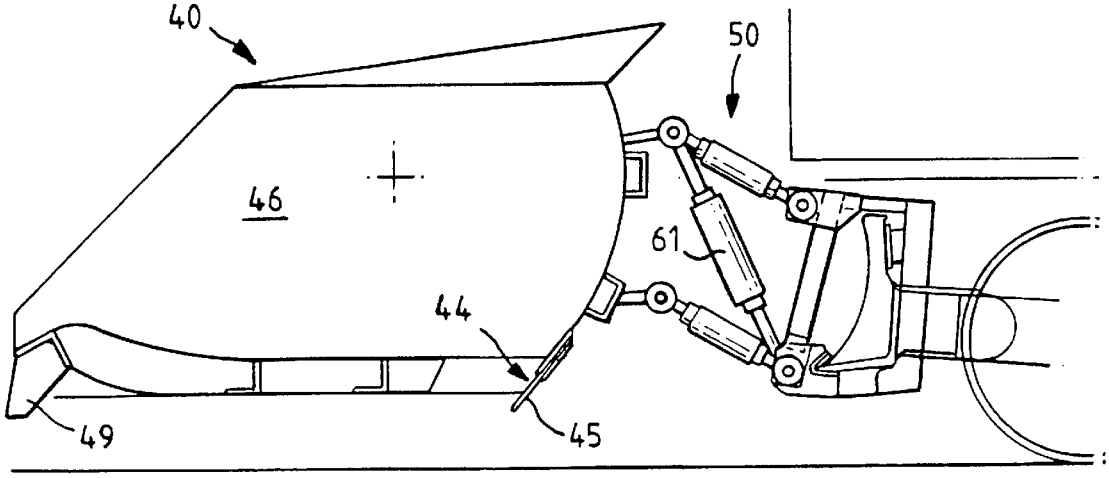
FIGS. 9 and 10 show schematically different attitudes of a device according to the invention, mounted on a dozer blade.
Figure 10:
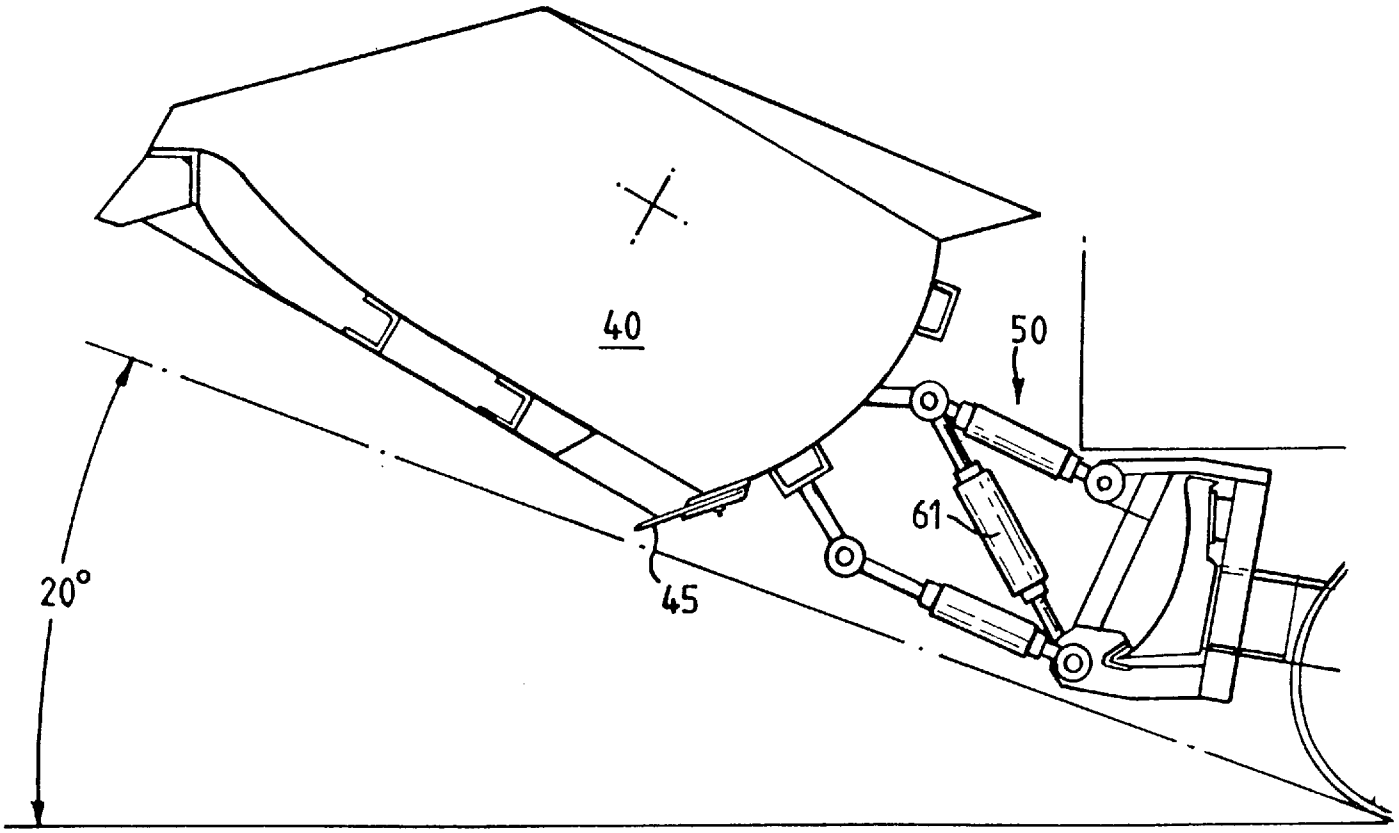

FIGS. 9 and 10 show respectively a substantially horizontal "stow" angle of the device and an angle of "stow" which is about 20°, thereby allowing the device to be carried up and down steep ramps, for example of 20° inclination (FIG. 10) for gaining access to or egress from a slow sand filter. The linkage 50 includes a diagonally extending hydraulic damper 61 (shown schematically). The action of this damper 61 is such that whatever the attitude of the linkage 50, the damper acts to set the angle so that the device 40 is maintained against the fluid pressure in the hydraulic damper in the desired attitude, with no stress being placed on the linkage 50 as such. This is more clearly shown in FIG. 13.

The bottom linkages 52 comprise means which, because of the action of the damper 61, are merely free to extend and retract from tilting, without having to "work" to support the device. It will be understood that the linkage 50 and damper 61 are operated via a suitable hydraulic circuit, not shown.

Figure 11:
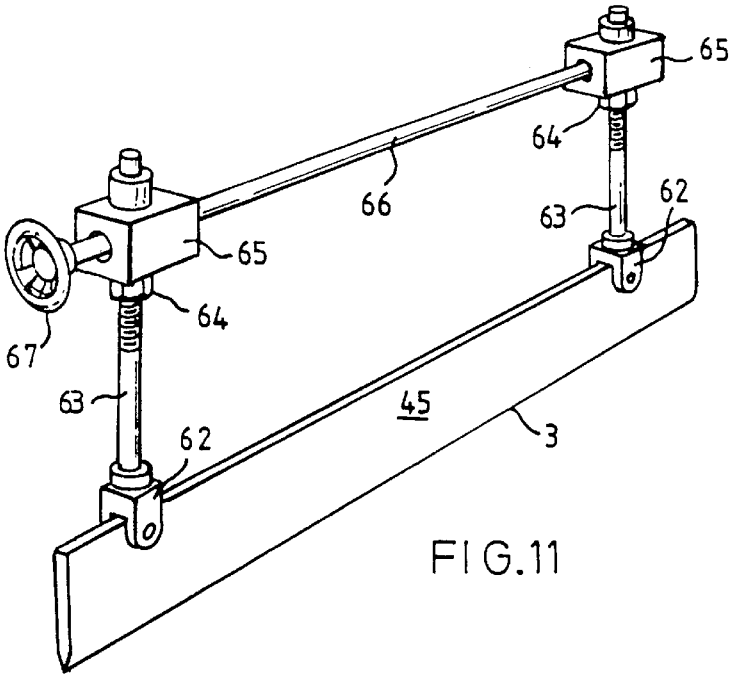
FIG. 11 shows schematically a height adjustment device for a blade of a device according to the invention.

FIG. 11 shows an alternative embodiment for adjusting the height of the blade for, in turn, adjusting the depth of skim of its cutting edge. The blade 45 has two yokes 62 in each of which is mounted a screw 63 which in turn are received via a rotatable nut 64 in a cross-shaft gear box 65, connected by a shaft 66 and one of which also has an actuating member in the form of a manually turnable handle or wheel 67. In operation, rotation of the handle 67 causes simultaneous upwardly or downwardly shifting of the blade 45 via the screws, gear boxes, shaft and screws, to provide an even raising or lowering of the blade and hence of its cutting edge 3. The screws 63 are encased in a bellows or other flexible sleeve or shroud to keep them free of foreign bodies such as sand.

It will be understood that the cross-shaft gearboxes can be replaced, in another embodiment, not shown, by a crankshaft, hydraulic lifting means, servo-motors, or the like.

Figure 12:
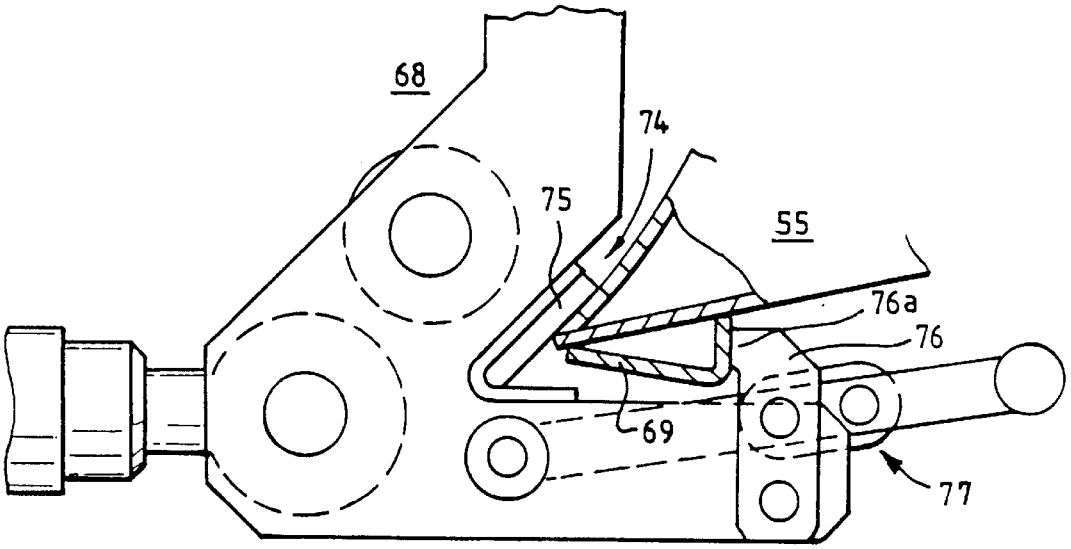
FIGS. 12 and 13 show enlarged details of mounting of a device according to the invention on a dozer blade.
Figure 13:
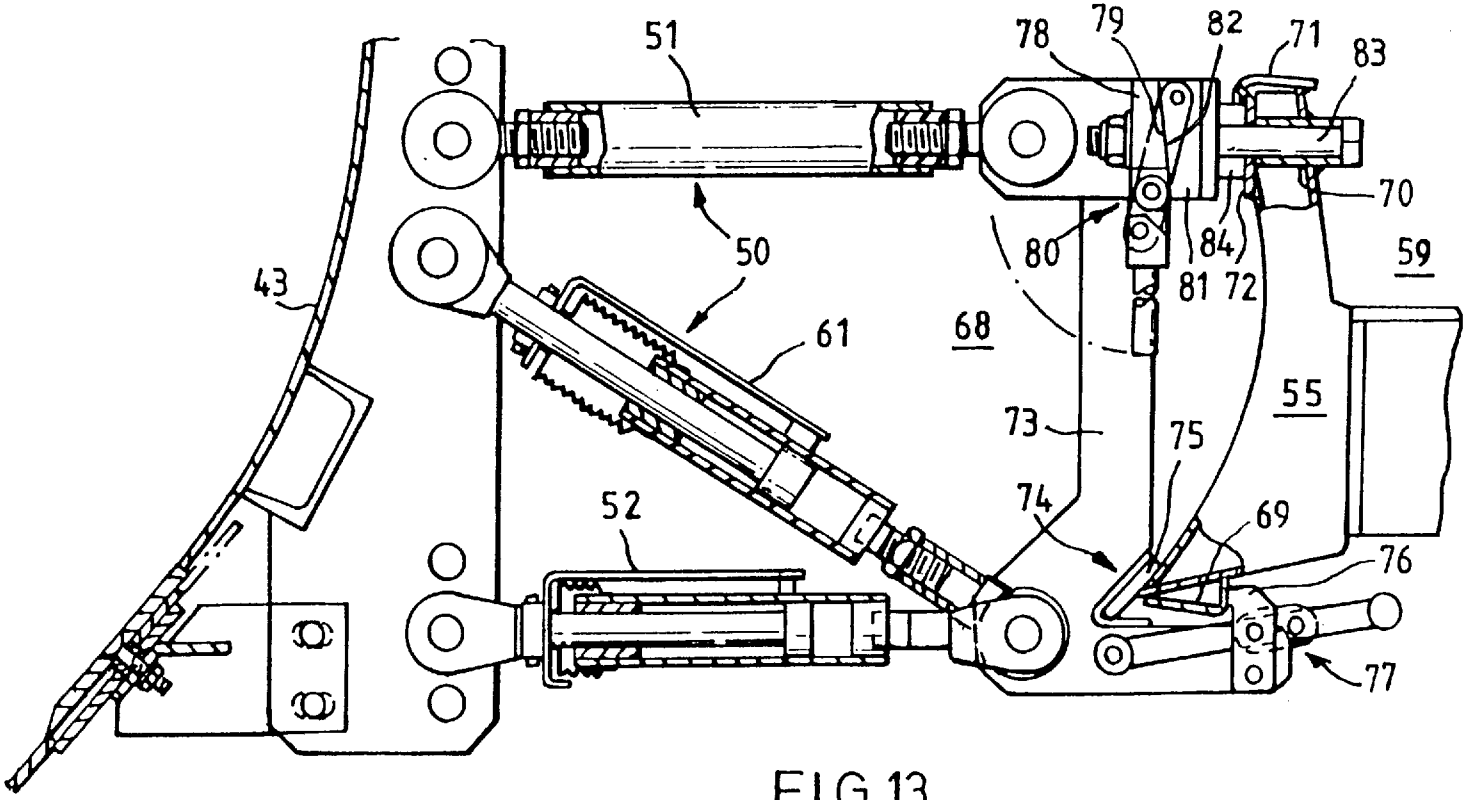

Referring now to FIGS. 12 and 13, there is shown in more detail a clamping system 68, in the embodiment a quick release system, for mounting the device 40 on the dozer blade 55. The dozer blade 55 itself is modified in that it has an angle bracket 69 secured to it at its rear edge, lower part. The upper edge has a hole through it 70 and a locking cap 71 and spring plate 72. A mounting frame 73 connected to the linkage 50 of the device 40 has a receiving seat or mouth 74 with a pad or guide 75, the seat or moth 74 being of substantially V-shape. The frame 73 has a clamp member 76 connected with an over-centre toggle linkage 77, at the lower edge (as viewed) and which linkage has a spring means to provide the over-centre operation. The spring means is not shown. The upper edge of the linkage frame 68 carries a slide block 78 with an inclined surface 79, connected via another spring biassed over-centre toggle linkage 80 with a slide block 81 with an inclined surface 82 complementary to that 79 of the slide block 78 and in the opposite direction. The slide block 81 is mounted on a pin or bolt 83 which passes through the hole 70 in the dozer blade 55.

In use, the pin 82 is engaged in the hole 70 so guiding the device 40 and blade 55, the slide blocks 78, 81 being loosely in contact at surfaces 79, 82. In this position the lower edge of the dozer blade is in the mouth or seat 74. The dozer 59 is then driven forward, so pushing the dozer blade 55 forward. This action causes the lower edge of the dozer blade 55 to go forward into the mouth or seat 74, sliding down the guide plate 75, and at a certain point the toggle linkage 77 is sprung over-centre by its spring so that nose 76*a* of the locking device 76 is forced firmly against the rear of the bracket 69, simultaneously, the slide surfaces 79, 82 slide over each other until the spring of the other toggle-linkage 80 acts to snap that toggle linkage over-centre, and hence firmly clamp the two slide blocks 78, 81 together. This action forces a block 84 on the guide block to lock firmly under the locking clamp 71 at the top of the blade so firmly locking the upper part of the frame and hence of the dozer blade, together, FIG. 13. The device and dozer blade are thus firmly locked together as one unit. A reversal of the dozer and dozer blade acts in the reverse direction to spring the toggle linkages back over-centre, to allow the device and dozer blade to be separated.

Figure 14:
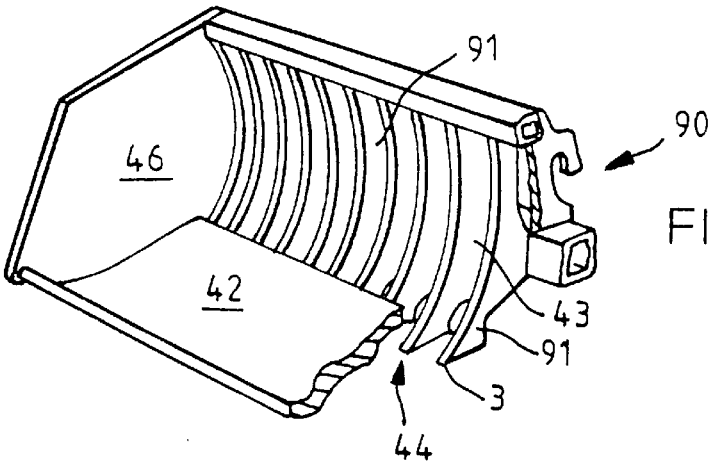
FIGS. 14 and 15 show respectively front and rear views of a further embodiment of device according to the invention.
Figure 15:
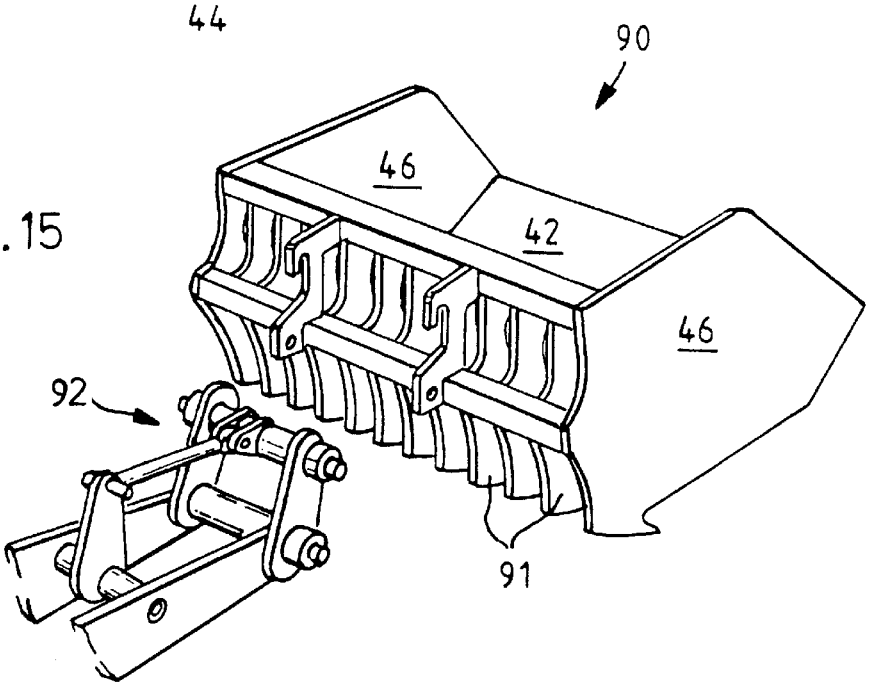

Referring now to FIGS. 14 and 15, the device 90 shown there is similar to that previously described, in that there is a body, with a skid, and a rear wall separated from the skid by a gap 44 through which skimmed sand (in the case of a slow sand filter) is removed to the device. The rear wall 43 is itself in this embodiment in the form of a series of fingers or walls 91 the lower edges of which lie in the same plane to define an edge 3 for skimming the substrate. The thickness of skim is controlled by means in the form of a linkage 92 for adjusting the height of the device bodily, FIG. 15.

It will be understood that in use further adjustability of the depth of skim is achievable by operation of the dozer blade controls.

Figure 16:
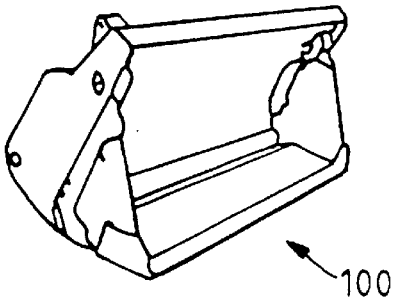
FIG. 16 Prior Art
FIGS. 16 and 17 show buckets which can be used with a device according to the invention.
Figure 17:
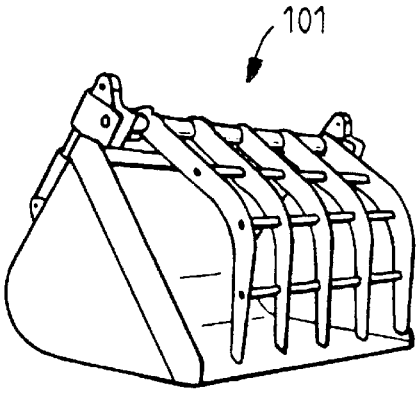
FIG. 17 Prior Art

Spoil, or skimmed material, can be removed by "opening clam" kind of buckets 100, 101 shown respectively in FIGS. 16 and 17 which are mounted on the dipper arm of the excavator and are used to off-load collected spoil, or weed collected ahead of the skid or roller. However, a non-clam kind of bucket, which is light and thus capable of carrying a greater pay load, can be utilized where there is, for example, no requirement to lift debris and/or weed.

It will also be understood that although a slow sand filter has been referred to, all the devices described herein can also be used in skimming/cleaning of other substrates, such as a beach which might be polluted with say spilled oil.

It will also be understood that further modifications are possible. Thus there may be means for the provision of automatic vertical height adjustment, without the need for raising and lowering the dozer blade per se. Also, although excavators/mini- and midi- have been described, a device embodying the invention may be used in other applications, either alone, or with a tractor, for example.

I claim:

1. A device for skimming a layer from a substrate over which the device is in use traversed, comprising:

(i) a body;

(ii) an edge defined by the body for skimming the substrate;

(iii) a collector for material skimmed;

(iv) means for controlling the thickness of skim;

(v) the body having a curved wall for directing skimmed material into the collector; and (vi) releasable clamping means for clamping the device to a blade mounted to a dozer, the clamping means comprising:

toggle means for clamping the device to the blade of the dozer, and inter-slidable blocks for clamping the device at at least one edge of the dozer blade, one of the inter-slidable blocks being mountable in a hole in the dozer blade.

2. A device as defined in claim 1, wherein there is a blade of the body defining the edge for skimming and wherein the means for controlling the thickness of skim comprises adjustable means for adjusting the position of the blade in relation to a fixed part of the device.

3. A device as defined in claim 1, wherein there is a fixed part of the device comprising a rear wall of the device and wherein the rear wall is separated from a floor of the device by a gap through which skimmed material can pass.

4. A device as defined in claim 3, wherein the blade is mounted on a forward surface of the rear wall.

5. A device as defined in claim 3, wherein the blade is mounted on a rear surface of the rear wall of the device.

6. A device as defined in claim 2, wherein the adjustable means comprises an arrangement of a series of holes and a bolt means for passing through aligned holes of the series.

7. A device as defined in claim 2, wherein the adjusting means comprises a lifting arrangement for moving the blade bodily.

8. A device as defined in claim 7, wherein the lifting arrangement comprises a manually operable rotatable shaft and gear box arrangement.

9. A device as defined in claim 1, wherein the device comprises an undersurface with a high slip surface.

10. A device as defined in claim 9, wherein the high slip surface comprises a surface of a stainless steel skid part of the body of the device.

11. A device as defined in claim 1, wherein the body has pivot means for pivotal movement of the device in relation to a dozer blade.

12. A device as defined in claim 11, wherein there is releasable clamping means whereby the device is releasably mountable on apparatus for moving the device.

13. A device as defined in claim 1, wherein there is a clamp plate adapted to clamp a part of the dozer blade opposite the clamp blocks.

14. A device as defined in claim 1, wherein the body comprises a substantially U-shaped member having limbs and a web wherein said limbs and web comprise the collector and a lower (in use) edge of the web comprises the skimming edge.

15. A device as defined in claim 1, wherein there is a skid mounted on a leading edge of the device.

16. A device as defined in claim 15, wherein there is a plurality of skiis.

17. A device as defined in claim 1, wherein there is a plurality of forwardly projecting tines for collecting weed.

18. In combination, a dozer blade and a device as defined in claim 1.

19. A dozer, including a combination as defined in claim 18.

* * * * *